United States Patent [19]

Finkelstein et al.

[11] Patent Number: 4,991,259

[45] Date of Patent: Feb. 12, 1991

[54] BUTT MOUNTED RISER HINGE

[75] Inventors: Burl Finkelstein; Mel Lehto, both of Newnan, Ga.

[73] Assignee: Kason Industries, Inc., Shenandoah, Ga.

[21] Appl. No.: 397,916

[22] Filed: Aug. 24, 1989

[51] Int. Cl.[5] ..... E05F 1/12

[52] U.S. Cl. ..... 16/312; 16/316

[58] Field of Search ..... 16/273, 312, 316, 318, 16/315, DIG. 27, 263, 284

[56] References Cited

U.S. PATENT DOCUMENTS

| | | | |
|---|---|---|---|
| 879,542 | 2/1908 | Hartman | 16/318 |
| 1,691,759 | 11/1928 | Fischer | 16/316 |
| 1,942,715 | 1/1934 | Kungelman | 16/318 |
| 3,292,204 | 12/1966 | Tansey | 16/263 |
| 3,545,032 | 12/1970 | Dielman | 16/153 |
| 3,733,650 | 5/1973 | Douglas | 16/312 |
| 3,748,688 | 7/1973 | Berkowitz | 16/312 |
| 4,030,161 | 6/1977 | Loikitz | 16/284 |
| 4,190,925 | 3/1980 | Koivusalo | 16/54 |
| 4,631,777 | 12/1986 | Takimato | 16/315 |
| 4,692,963 | 9/1987 | Barroero | 16/275 |

*Primary Examiner*—Richard K. Seidel
*Assistant Examiner*—James Miner
*Attorney, Agent, or Firm*—Kennedy & Kennedy

[57] ABSTRACT

A butt mounted riser hinge has a plastic cam assembly mounted in two metallic cylinders so that their camming surfaces do not rub against the metallic cylinders and become readily worn. The cam assembly includes a male member with bevelled end that is rotatably received in a cup-shaped female member. The hinge further includes a spring and shell assembly in sliding arrangement with one of the metallic cylinders.

1 Claim, 2 Drawing Sheets

BUTT MOUNTED RISER HINGE

TECHNICAL FIELD

This invention relates to door hinges, and, more particularly, to butt mounted riser hinges used on heavy doors such as on commercial refrigerators and the like.

BACKGROUND OF THE INVENTION

Heavy doors, such as those used on walk-in refrigerators, are often mounted to jambs by butt mounted riser type hinges which lift the door when it is swung open, and which use gravity to assist in the closing of the door. A butt mounted hinge is one which has two barrels mounted one above the other. Each barrel has a mounting flange laterally extending therefrom, and generally, the flanges are side by side in the based position of the hinge, in the space between the door and the jamb. The flange of one barrel is secured to the door edge and the flange of the other barrel is secured to the jamb. With this configuration, flange mounting screws are inaccessible when the door is in its closed position. Therefore when closed and locked, the door may not be opened by merely removing the hinge. This provides a high degree of security. The butt mounted hinge is also aesthetically pleasing, inasmuch as when the door is closed the hinge flanges are concealed.

A riser hinge is a hinge which incorporates a means for raising the door as it is swung open. Typically this is in the form of a camming arrangement in which the barrel of the hinge mounted to the door rides up a camming surface as the door swings open, thereby lifting the door. This feature is desirable for two reasons. Firstly, as the door is swung open the clearance between the bottom of the door and the floor is increased, so that door operation is not hindered by small objects resting on the floor or floor variances in its path. The problem of floor clearance is important where the refrigerator floor and the adjoining floor are at the same level since to assure a good seal the door must fit tightly against the floor when fully closed, yet have ample clearance when being swung open. Secondly, once the camming system has been actuated by opening the door, the door may be automatically closed upon being let go, with the weight of the door itself actuating the camming system in the reverse direction.

Riser hinges are also usually made of two parts that have axially aligned metallic barrels from which mounting flanges laterally extend. Mounted in each barrel is a cylindrical camming element made of a smooth, low friction material such as a hard plastic. Their mutually confronting ends are bevelled. Thus, as the barrel of the part mounted to the door is rotated, its bevelled camming element is driven upwardly upon the bevelled end surface of the other camming element, thereby causing the door to rise. Exemplary of a hinge which is both butt mounted and riser as that shown in U.S. Pat. No. 3,545,032.

A problem long associated with this type of hinge is that not only is there frictional contact on the bevelled cam surfaces but also on the cylindrical surface of one of the camming elements as it rises or falls and simultaneously rotates within a stationary barrel. This sliding contact movement of a relatively soft camming element and relatively hard metallic barrel causes the side wall of the cam element to become worn and deformed, thus it must be replaced from time to time. The weight of the door also causes a bending moment on the hinge inasmuch as the center of gravity of the door is laterally offset from the axis of the hinge. This bending moment in turn increases the frictional pressure between the cam element side wall and that of the barrel, thereby increasing the wear of the cam follower.

It thus is seen that a need remains for a heavy duty butt mounted riser hinge which alleviates problems associated with those of the prior art. It is to the provision of such therefore that the present invention is primarily directed.

SUMMARY OF THE INVENTION

In another preferred form of the invention a butt mounted riser hinge has a pair of barrels from which mounting flanges extend which are made of relatively hard, sturdy material such as steel. The hinge also has a cam assembly that is made of relatively soft material such as nylon. The hinge is designed to avoid the relatively soft cam from making movements of its camming surfaces in direct contact with the relatively hard barrels during hinge operations. This is achieved with the cam assembly having a cup-shaped female member in which a male member is rotatably received with an obliquely oriented end of the male member in contact with an obliquely oriented floor of the cup-shaped female member.

DETAILED DESCRIPTION

Figure 1:
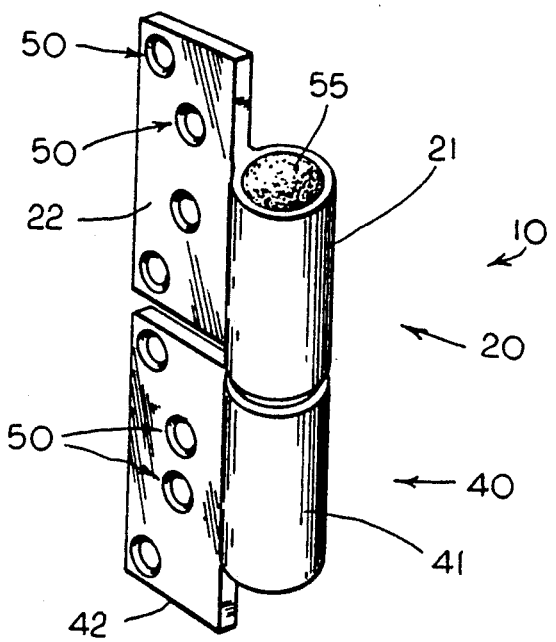
FIG. 1 is a perspective view of a hinge embodying principles of the invention in a preferred form.

With references now to FIGS. 1–4, there is shown a butt mounted riser hinge 10 that comprises a first part 20 which has a cylindrical barrel 21 and flange 22 of unitary, cast metal construction, with the flange 22 having a set of countersunk mounting holes 50. Fixedly mounted inside the barrel 21 is a cup-shaped female cam member 23 made entirely of smooth, low-frictional, plastic material such as nylon. The cam member has an internal floor, a bevelled first portion 24 which traverses the longitudinal axis A of the barrel at an oblique angle thereto. The floor has a second portion 24' which is perpendicular to the axis A. The two internal floor portions provide a camming surface. The female cam member also has a cylindrical, internal sidewall 25 which extends from the cam floor 24 to an open end 29. An axial bore hole 26 extends from the other cam end 27 to the floor portion 24. End 27 is formed with a notch 28 that engages an interior barrel flange 30 to fix the rotary position of the cam inside the barrel. A bearing 31 is also mounted inside the barrel 21 in abutment with the cam end 27.

The hinge 10 further comprises a second part 40 which also has a unitarily cast metal cylindrical barrel 41 and mounting flange 42 with countersunk mounting holes 50. Fixedly mounted inside the barrel 41 is a generally cylindrical male cam member 44 also made of the low frictional material. The male cam member has a base portion 44' of relatively large outside diameter and a protruding portion 44" of reduced outside diameter which, when mounted, protrudes out of the barrel 41. The base portion 44' has a notch 48 at the cam end opposite the protrusion 44". This notch is shaped to correspond to a flange 46 inside the barrel 41 to fix the rotary position of the male cam member.

The end 45 of the male member protruding portion 44" transverses the longitudinal axis A of the barrel at an oblique angle thereto. A second portion 45' is oriented perpendicularly to the axis A. The shape portions 45, 45' substantially match the floor portions 24, 24' of cam member 23. The outside diameter of the protrusion 44" closely matches the inside diameter of the sidewall 25 of the cup-shaped female cam member 23 and is telescopically received in it to form a camming assembly. An axial bore hole 47 extends through the male cam member 44 which is of the same size as the bore hole 26 in member 23.

A hinge pin 51 is axially mounted in the second hinge part 40 with its head 51' seated in the barrel 41 and with its shaft 51" extending through the male cam member bore hole 47, the bore hole 26' of the female cam member 23, and through the bearing 31. Finally, protective end caps 55 are press fitted into the open ends of the barrels 21 and 41 to prevent dirt and other foreign matter from entering the hinge.

Figure 2:
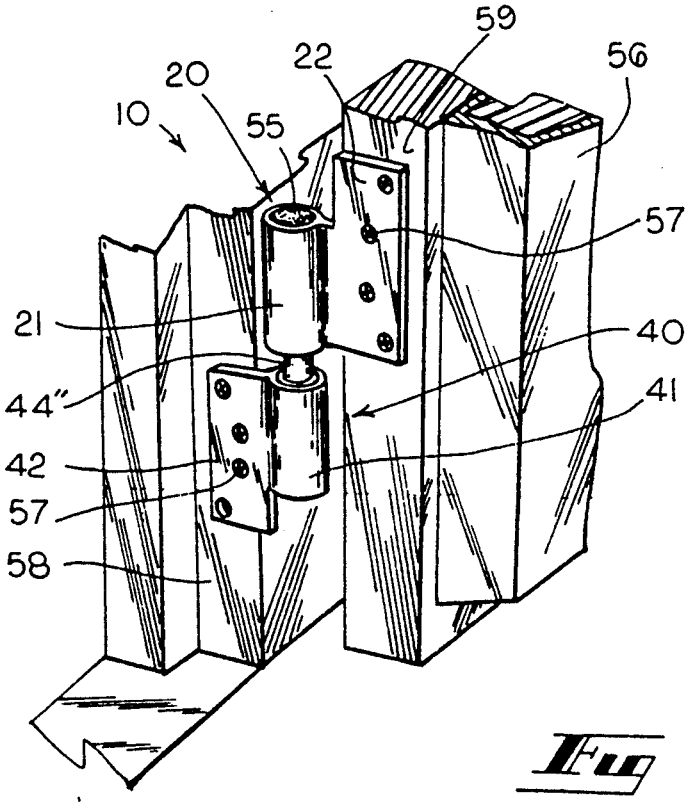
FIG. 2 is a perspective view of the hinge with one portion of the hinge mounted to a door and another portion mounted to a door jamb.

To mount the hinge the first part 20 is axially aligned with the second hinge 40 and the first hinge part mounted to the edge 59 of door 56, as shown in FIG. 2. In doing so, mounting screws 57 are passed through mounting holes 50 of the flange 22 and screwed into the door edge. The second part 40 is affixed to the door jamb 58 by passing screws 57 through the mounting holes of flange 42 and screwing them into the jamb. This all is done with the door elevated above the floor a sufficient distance so that it will still clear the floor when closed and thereby lowered.

In operation, as the door is swung open the hinge barrel 21 and female cam member 23 of part 20 rotate about the hinge pin 51 and about the male cam member 44 of part 40. As this occurs, the bevelled cam floor portion 24 of the cup-shaped cam member 23 rides up the male cam member end second portion 45' thereby causing the first hinge part 20 to rise. Its rising in turn lifts the door 56 as it is swung towards its open position shown in FIG. 2. The cam rotating and rising motion continues until the cam floor second portion 24' arrives upon the male cam member perpendicular second portion 45'. At this point further rotation of the cam assembly produces no vertical movement. Thus, if the door is released it will tend to remain stationary. Conversely, should the door be released before this occurs, the weight of the door will cause the camming assembly to close it as the female cam member 23 is returned to its at rest, closed position bringing the bevelled floor 24 flush against the male cam member bevelled end 45.

The bearing 31 rotatably holds the pin 51 in place so that it does not directly contact the cam bore hole 26 as the cam rotates. Thus, as the relatively soft cam member 23 rotates and rises it contacts only the relatively soft male cam member 44. Therefore, at no position does the low friction material of the two cam members wear upon a metallic surface. The absence of such serves to increases the useful life of the hinge.

Figure 5:
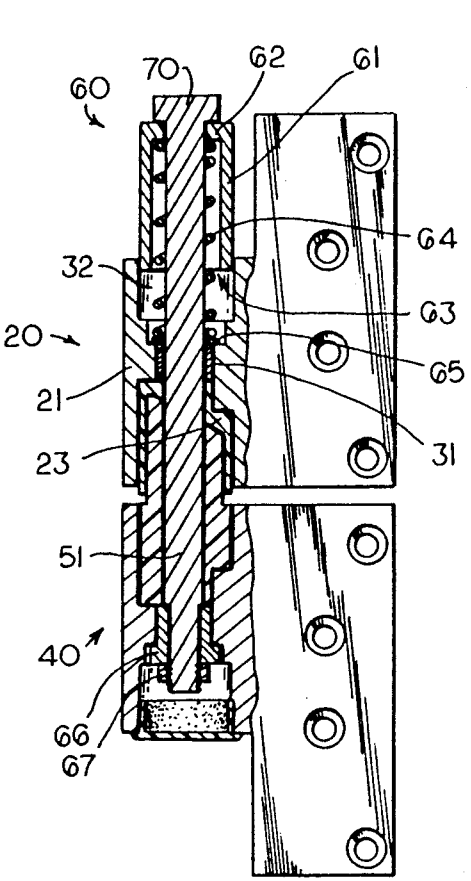
FIG. 5 is a cross-section of a hinge embodying principles of the invention in another preferred form.
Figure 4:
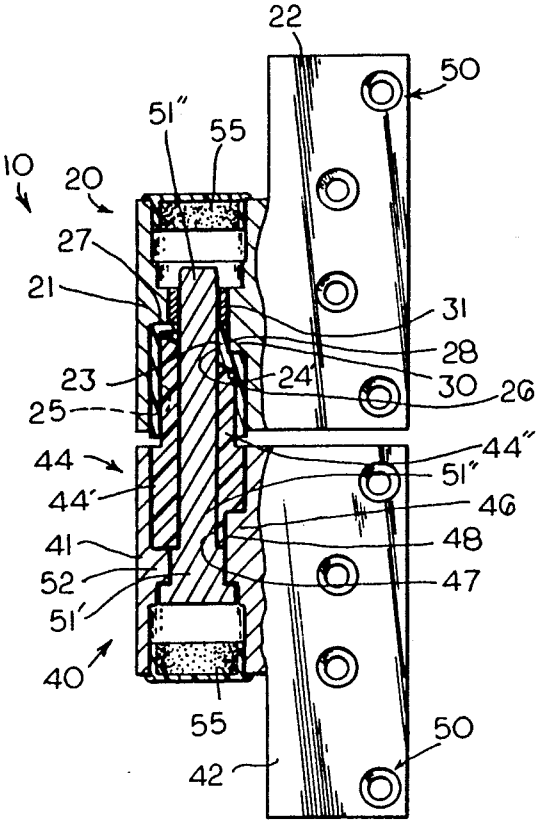
FIG. 4 is a cross-section of the hinge.
Figure 3:
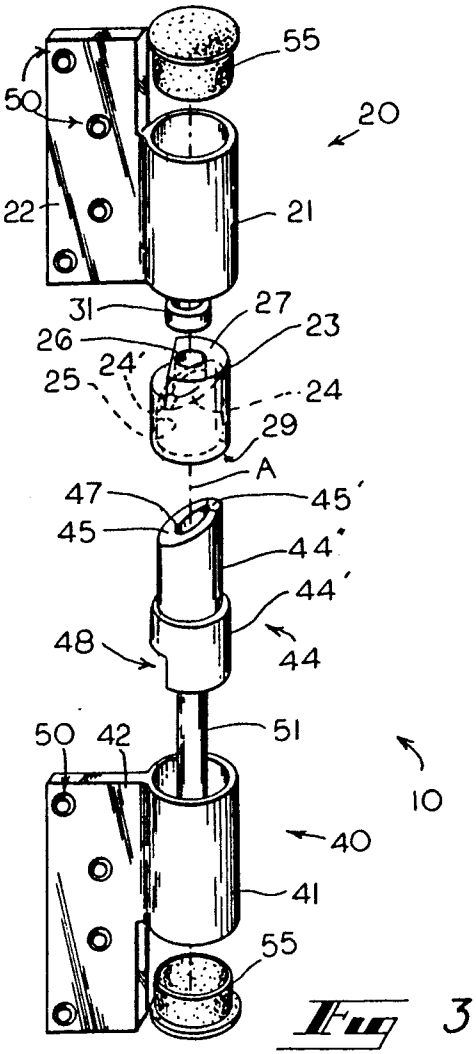
FIG. 3 is a exploded view of the hinge.

With reference next to FIG. 5, a butt mounted riser hinge with a spring assist assembly is illustrated that embodies principles of the invention in another form. The hinge here is of similar construction to that previously described. Here, however, the hinge has a spring assembly indicated generally at 60. More specifically, a spring shell 61 is slidably mounted in the open end 32 of barrel 21. The shell has an inturned or flanged outer end 62 and an inner open end 63. A compression spring 64 is mounted inside the shell in abutment with the inturned flanged end 62. The spring 64 extends beyond the open end 63 of the shell 61 into abutment with a thrust washer 65 which is seated adjacent an end of the bearing 31 against an annular ledge within barrel 21. Hinge pin 51 here extends through the shell 61, spring 64, washer 65, bearing 31, cam bore hole 26 and cam follower bore hole 47 and insert 66. In this embodiment it has a threaded end which is threaded into insert 66 and into a lock nut 67. The pin head 70 abuts the outside of sleeve end 62 to fix the position of shell 61 relative to part 40.

In use here, as the door 56 is swung open the first hinge part 20 rotates and the cam assembly causes it to rise as previously described. This rising motion causes the spring 64 to compress. Upon door release, the compressed spring acts in concert with the weight of the door in effecting an automatic closing.

It thus is seen that a butt mounted riser hinge is now provided which overcomes problems long associated with those of the prior art. It should, however, be understood that the just described embodiments merely illustrate principles of the invention in two preferred forms. Many modifications, additions and deletions may, of course, be made thereto without departure from the spirit and scope of the invention as set forth in the following claims.

We claim:

1. In a butt mounted rise hinge of the type having a pair of metallic barrels in which a substantially non-metallic cam assembly is housed, the improvement comprising said cam assembly having a cup-shaped female member that has a cylindrical interior side wall and a floor at least a portion of which is oriented obliquely with respect to said cylindrical side wall; a male member telescopically received in said female member and having a cylindrical side wall and an end at least a portion of which is oriented obliquely with respect to said cylindrical side wall in abutment with said female member floor; said female member floor having a cylindrical passageway therethrough located along the axis of said female member cylindrical sidewall; said male member having a cylindrical passageway therethrough; a metallic pin that extends through said female member floor passageway and said male passageway; a tubular sleeve slidably mounted to one of said barrels; a compression spring mounted in said sleeve operatively compressible between an end of said sleeve and said one barrel; and wherein said pin is threadedly mounted to said other barrel with a head of said pin holding said sleeve in a fixed position relative to said other barrel.

* * * * *